US005591032A

United States Patent [19]

Powell et al.

[11] Patent Number: 5,591,032

[45] Date of Patent: Jan. 7, 1997

[54] LASER WEAPON SIMULATOR APPARATUS WITH FIRING DETECTION SYSTEM

[75] Inventors: Richard L. Powell, 8711 NW. 121st St., Grimes, Iowa 50111; W. Joe Jacobsen, Perry, Iowa

[73] Assignee: Richard L. Powell, Grimes, Iowa

[21] Appl. No.: 409,336

[22] Filed: Mar. 23, 1995

[51] Int. Cl.[6] ..... F41G 3/26

[52] U.S. Cl. ..... 434/22; 434/19

[58] Field of Search ..... 434/11, 16, 19, 434/21, 22

[56] References Cited

U.S. PATENT DOCUMENTS

| | | | |
|---|---|---|---|
| 3,792,535 | 2/1974 | Marshall et al. | 434/22 |
| 4,352,665 | 10/1982 | Kimble et al. | 434/22 |
| 4,561,849 | 12/1985 | Eichweber | 434/22 |
| 4,592,554 | 6/1986 | Gilbertson | 273/312 |
| 4,640,514 | 2/1987 | Myllyla et al. | 434/22 X |
| 5,194,007 | 3/1993 | Marshall et al. | 434/21 |

*Primary Examiner*—Gene Mancene
*Assistant Examiner*—Jeffrey A. Smith
*Attorney, Agent, or Firm*—G. Brian Pingel; Brett J. Trout

[57] ABSTRACT

A laser weapon simulator apparatus for practice in the shooting of a firearm at a target having reflective material thereon. The apparatus includes a laser beam transmitter that is actuable to emit a laser beam of short duration, a laser beam receiver for collecting and processing a reflected portion of the laser beam, circuitry for detecting the emission of the laser beam by the transmitter, and a visual display. The receiver includes circuitry adapted to produce a "hit" signal upon receiving the reflected portion of the laser beam and the detecting circuitry is adapted to produce a "try" signal in response to the emission of the laser beam. The visual display produces an output "hit" display signal upon the concurrent receipt of a "hit" signal from the receiver and a "try" signal from the detecting circuitry.

6 Claims, 8 Drawing Sheets

LASER WEAPON SIMULATOR APPARATUS WITH FIRING DETECTION SYSTEM

BACKGROUND OF THE INVENTION

1. Field of the Invention

The present invention relates in general to apparatus to simulate the shooting of a firearm and more particularly to such apparatus that is designed to verify the accuracy of the shot.

2. Description of the Prior Art

A wide variety of laser beam transmitting devices are known in the art for simulating the shooting of a firearm. Apparatus are also known in the art that include a receiver for detecting reflected portions of the transmitted laser beam to provide an indication to a user of a simulated "hit."

Many of the known prior art apparatus are utilized for the simulated shooting at stationary targets. However, apparatus are also well-known in the art that are designed for simulating the shooting at a moving target, such as might be experienced for example with clay pigeon shooting as disclosed in U.S. Pat. No. 4,592,554 issued to Gilbertson or by a product being sold by Phase Laser Systems, Inc. under the name Beamer Line.

The simulated shooting apparatus of Gilbertson includes a transmitter that is positioned in the outer end of a weapon such as a shotgun and a receiver that is mounted on the weapon. The transmitter and receiver are connected by a link bridge formed of power and signal wires so that the receiver is activated upon the firing of the transmitter. Also, the transmitted beam is deflected to more accurately simulate the firing to allow for the difference in the speed of the laser beam and the speed of a bullet.

In several respects the Beamer Line is similar to the Gilbertson apparatus in that it is installed in the outer end of a shotgun barrel, emits a laser light beam, and can be used for perfecting shooting skills at moving targets. However, such apparatus does not have any receiving means for electronically detecting and recording the result of firing a shot other than through the visual detection of a "hit."

Another type of firearm simulator apparatus is disclosed in U.S. Pat. No. 3,792,535 issued to Marshall et al., but in contrast to the apparatus of Gilbertson, includes a transmitter and receiver that do not have an electrical link bridge to activate the receiver upon the firing of the transmitter.

The present invention is relatively simplistic in design and yet provides a new and improved firearm simulator apparatus that is easy to operate and provides enhanced operational results.

SUMMARY OF THE INVENTION

The present invention provides a laser weapon simulator apparatus for practice in the shooting of a firearm at a target having reflective material. The apparatus comprises a laser beam transmitter, a receiver for detecting a portion of a reflected laser beam, and producing a "hit" signal in response thereto, a detecting means for producing a "try" signal in response to actuation of the transmitter, and display means that produces an output "hit" display signal upon the concurrent receipt of a "hit" signal from the receiver and a "try" signal from the detecting means.

In a preferred embodiment, the transmitter is contained in a housing that is positioned in the firing chamber of the firearm and is actuable when struck by the firearm firing pin to emit a modulated, high frequency laser beam of short duration. The receiver is mounted on the exterior of the firearm and H is not hard wired to the transmitter. The detecting means is designed to sense the emission of the laser beam from the transmitter and produce a "try" signal in response thereto.

DETAILED DESCRIPTION OF THE PREFERRED EMBODIMENT

Figure 1:
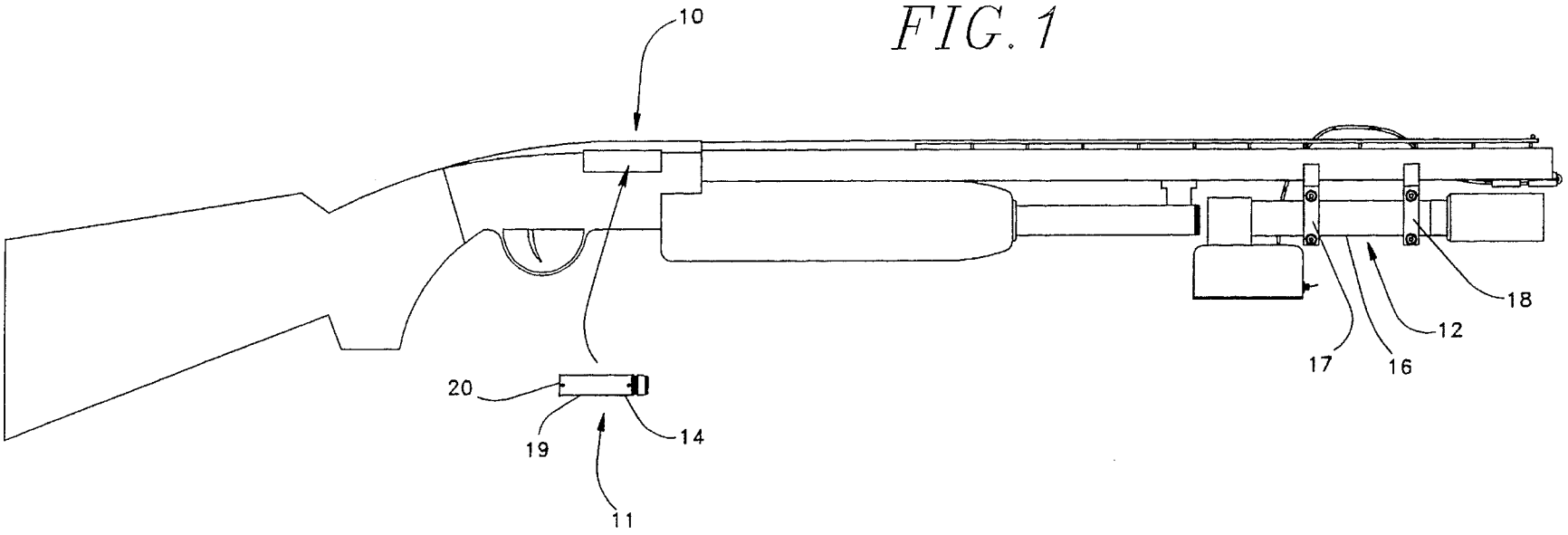
FIG. 1 is an elevational view of a shotgun shown with a transmitter and receiver that form a preferred embodiment of a weapon simulator apparatus of the present invention, with the receiver attached to the barrel of the shotgun.

The present invention is designed to provide a laser weapon simulator apparatus for practice in the shooting of a firearm at a target having at least portions covered with a reflective material. As indicated in FIG. 1, the invention is preferably designed to be utilized in conjunction with a firearm such as a shotgun 10 and a preferred embodiment of the invention includes a transmitter 11 and a receiver 12.

Figure 2:
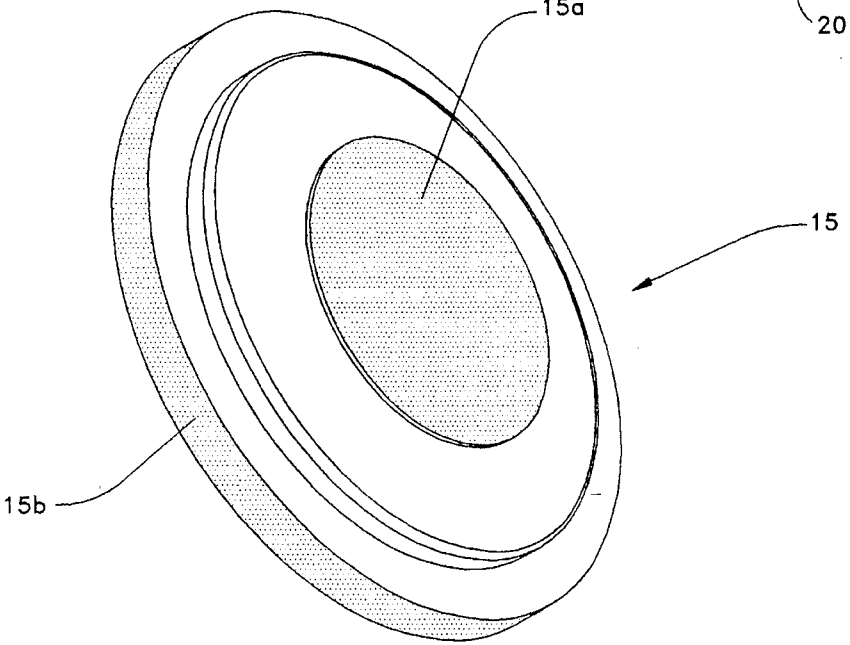
FIG. 2 is a perspective view of a clay pigeon adapted to be utilized with the weapon simulator apparatus of FIG. 1.

The transmitter 11 is contained in a housing 14 formed in the shape of a shotgun shell so that it may be inserted into the firing chamber of the shotgun 10. The transmitter 11 is actuated by the shotgun firing pin to emit an infrared, modulated laser beam directed out of the shotgun barrel toward a target covered with a light reflective material such as a clay pigeon 15, shown in FIG. 2, having reflective portions 15*a* and 15*b*.

Figure 3:
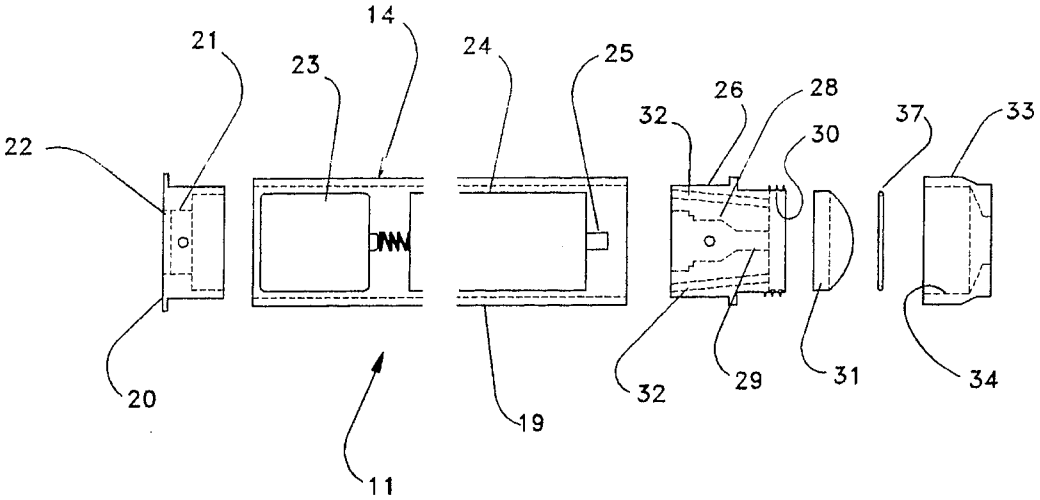
FIG. 3 is an enlarged longitudinal cross-sectional view of the transmitter of FIG. 1.

The receiver 12 has an elongated housing 16 that is preferably secured to the barrel of the shotgun by mounting members 17 and 18. Thus, the receiver 12 is located directly beneath the shotgun barrel so that when the laser beam emitted from the transmitter 11 strikes the pigeon 15 a portion of the reflected laser beam from the pigeon is collected by the receiver 12. With reference now to FIG. 3, the transmitter housing 14 has a tubular shaped body 19 with a rear end 20 in which a momentary switch 21, such as a Panasonic membrane momentary switch, is located. The switch 21 has a latex rubber membrane 22 that is constructed of a latex rubber disk with an aluminum disk adhered to the switch side. Actuation of the switch 21 occurs when the firing pin of the shotgun 10 strikes the membrane 22, which absorbs most of the energy of the firing pin. The central portion of the body 19 is hollow and contains a transmitter battery 23, that is preferably a lightweight lithium battery, and a circuit board 24 for the transmitter electrical circuitry of FIG. 4. Positioned in the front of the circuit board 24 is a laser diode 25 directed toward the front end of the housing 14.

An optical plug member 26 is received in the front end of the body 19 and has an interior with an aperture portion 28. When the body 19 and plug member 26 are fit together, the rear end of the aperture portion 28 contains the diode 25. Rather than having the diode 25 connected directly to the circuit board 24 as indicated in FIG. 3, it may be preferable from a positioning standpoint to have the diode 25 permanently mounted in the proper position in the aperture portion 28. In such event, for assembly purposes, the circuit board 24 must be removable from the housing 14.

The forward end of the aperture 28 has a circularly shaped laser beam shaping tunnel 29 that terminates in a recessed portion 30 to serve as a seat for a collimating plano-convex lens 31. Together, the tunnel 29 and collimating lens 31 act to convert the elliptically shaped beam provided by the diode 25 into a circularly shaped output beam.

To insure that the laser beam produced by the transmitter 11 is directed along a line parallel with the longitudinal axis of the shotgun barrel, the collimating lens 31 can be adjustably aligned by the use of three adjusting screws 32 (only two of which are shown) in the plug member 26 to tilt the lens 31 and align the beam down the barrel. In addition, the adjusting screws 32 allow a convenient means of adjusting the beam pattern to a preferred size of a thirty inch diameter at a position 120 feet from the end of the shotgun barrel.

A lens cap 33 is threadably attached to the front of the plug member 26 and has an interior aperture portion 34 with a large circularly shaped rear dimension that tapers to a smaller circularly shaped front dimension that act to further focus the beam from the laser diode 25. Also, an O-ring 37 is included in the lens cap 33 to bear against the collimating lens 31 to secure it in place.

Figure 4:
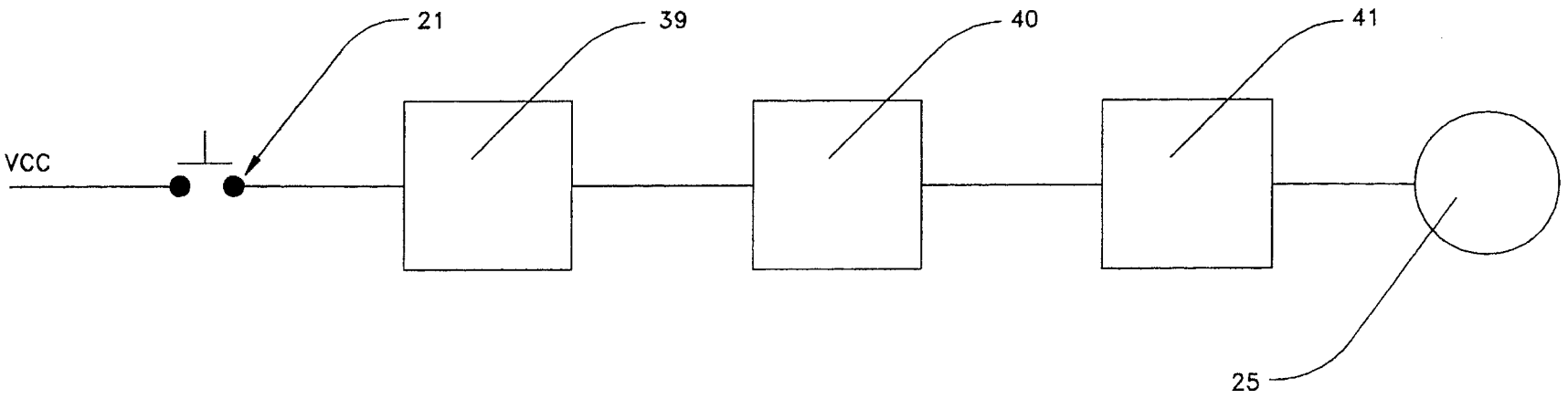
FIG. 4 is a block diagram of the electrical circuit of the transmitter of FIG. 1.

Referring now to FIG. 4, the transmitter has four basic function blocks that are powered by the battery 23: a transmit timer circuit 39; a crystal oscillator-shaper circuit 40; a laser diode driver 41 in the form of a switched, constant current source; and the laser diode 25. The timer circuit 39 includes a one shot multi-vibrator that generates a 60 millisecond output signal when the battery switch 21 is actuated by the firing pin of the shotgun 10.

The oscillator 40 is operational at all times and generates a 32.768 kHz signal that the receiver is tuned to receive. Upon the generation of the one shot signal from the timer circuit 39, a modulated 32.768 kHz output signal of 60 millisecond duration is provided to the laser diode driver 41. In response, the diode driver 41 acts to switch the laser diode 25 on and off with a desired current sufficient to fire the laser and prevent an eroding of the laser beam signal as the voltage of the battery 23 becomes weaker. The laser diode 25 converts the modulated electrical signal pulses from the diode driver 41 into a modulated light pulse that is directed through the collimating lens 31, and out the barrel of the shotgun 10 at the target 15.

To differentiate interfering background light from the transmitter signal, the output of the laser diode 25 is electronically modulated. Because of a desire for the invention to operate indoors, the modulation frequency for the diode was chosen at the high infrared frequency of 32.768 kHz to avoid most manmade interference.

The laser diode 25 is not a particularly stable device and has very stringent current requirements. In order to start lasing, the current must be greater than a given threshold current level, but must not go above an absolute maximum current level or the device will burnout. To further complicate matters, both of these levels are temperature sensitive. Two types of diode failure may occur. First, the device may overheat due to excessive current and be damaged or second, damage may occur due to the fact that the optical interfaces may withstand only a set amount of optical power. If this level is too great, the laser will draw current, but no longer lase due to mirror damage.

In view of the above factors, the laser drive circuitry preferably includes an operational amplifier that is biased at a 2.5 volt reference, a voltage divider to set the current level through the diode, and an emitter follower to power the laser diode 25. By adjusting the voltage divider and the emitter resistor, a constant current source is provided that is independent of the source voltage to maintain operation of the diode 25.

Figure 5:
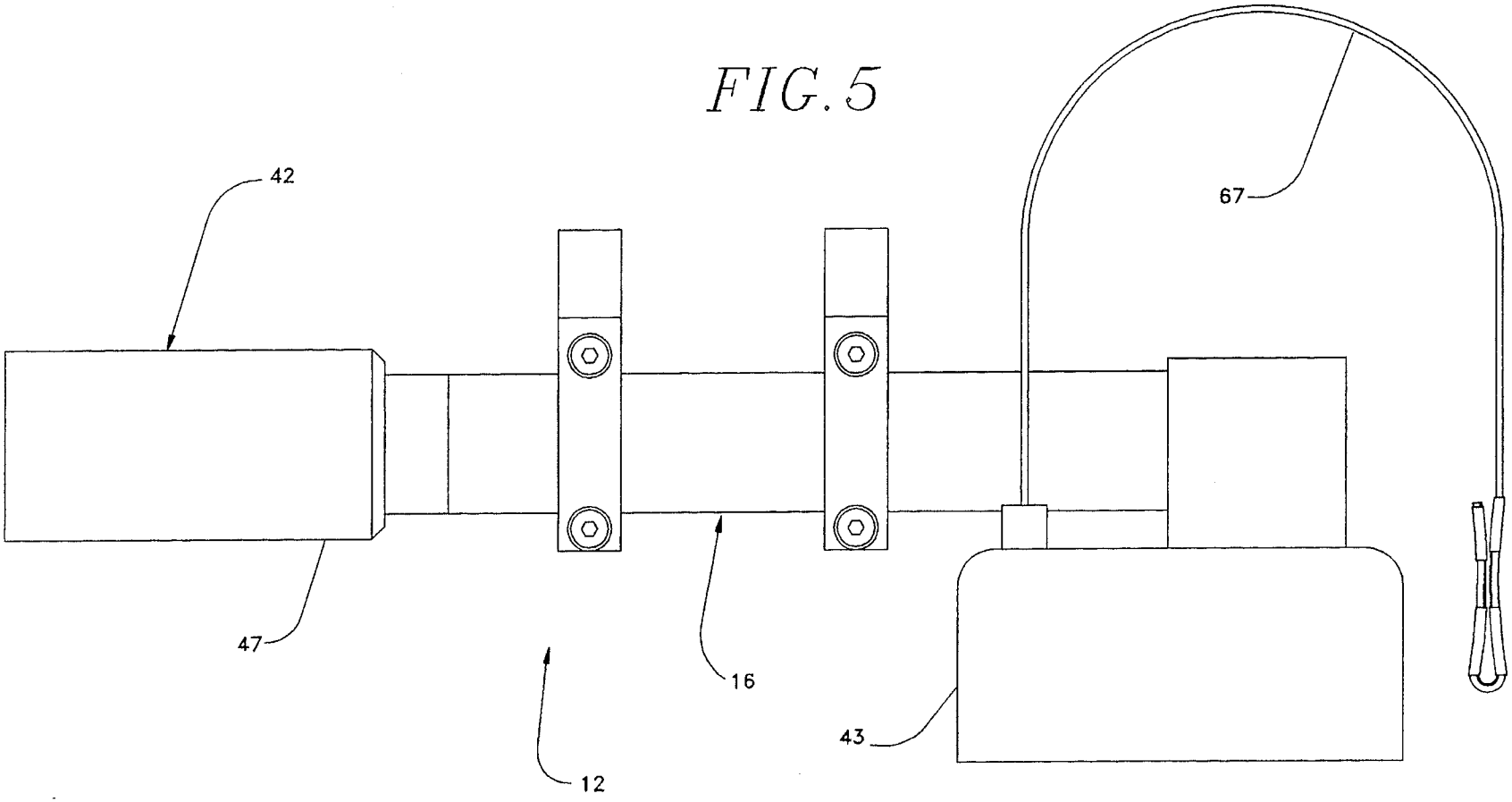
FIG. 5 is a side view in elevation of the receiver of FIG. 1.

Turning now to the configuration and operation of the receiver 12, the receiver housing 16 is best shown in FIG. 5 and includes a light collecting front portion 42 and a rear portion 43 that contains the electrical circuitry for a receiving circuit 44 (FIG. 7), a detecting circuit 45 (FIG. 8) and a display circuit 46 (FIG. 9), all of which can be actuated by an on/off switch (not shown) on the portion 43.

Figure 6:
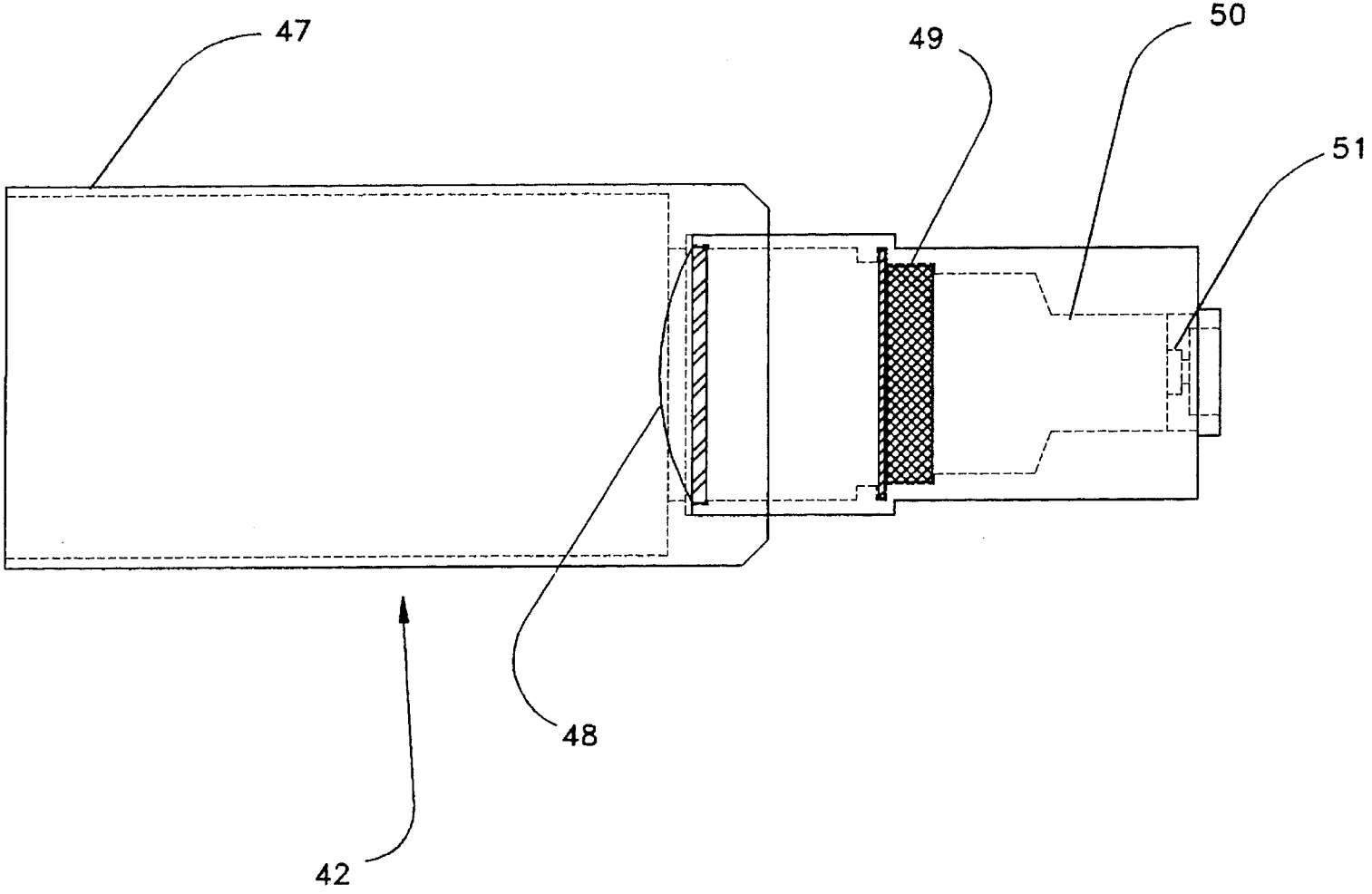
FIG. 6 is an enlarged longitudinal cross-sectional view of a hood and optics portion of the receiver of FIG. 1.

Referring now to FIG. 6, the light collecting portion 42 has a front hood 47 that is tubularly shaped and is approximately 4" to 5" long. The primary purpose of the hood 47 is to provide a light shield to prevent direct sunlight from striking a collimating plano-convex lens 48 located in the light collecting portion 42 toward the end of the hood 47. Also, the hood 47 reduces the field of view of the receiver 12 to a narrow area around the pigeon 15. The reflected laser beam from the clay pigeon 15 passes through the hood 47 and is focused by the lens 48 and then directed through an infrared band pass filter 49 and an aperture 50 located behind the filter 49. The aperture 50 provides approximately a forty degree field of view for a photodiode 51 disposed in the rear end of the aperture 50.

Figure 7:
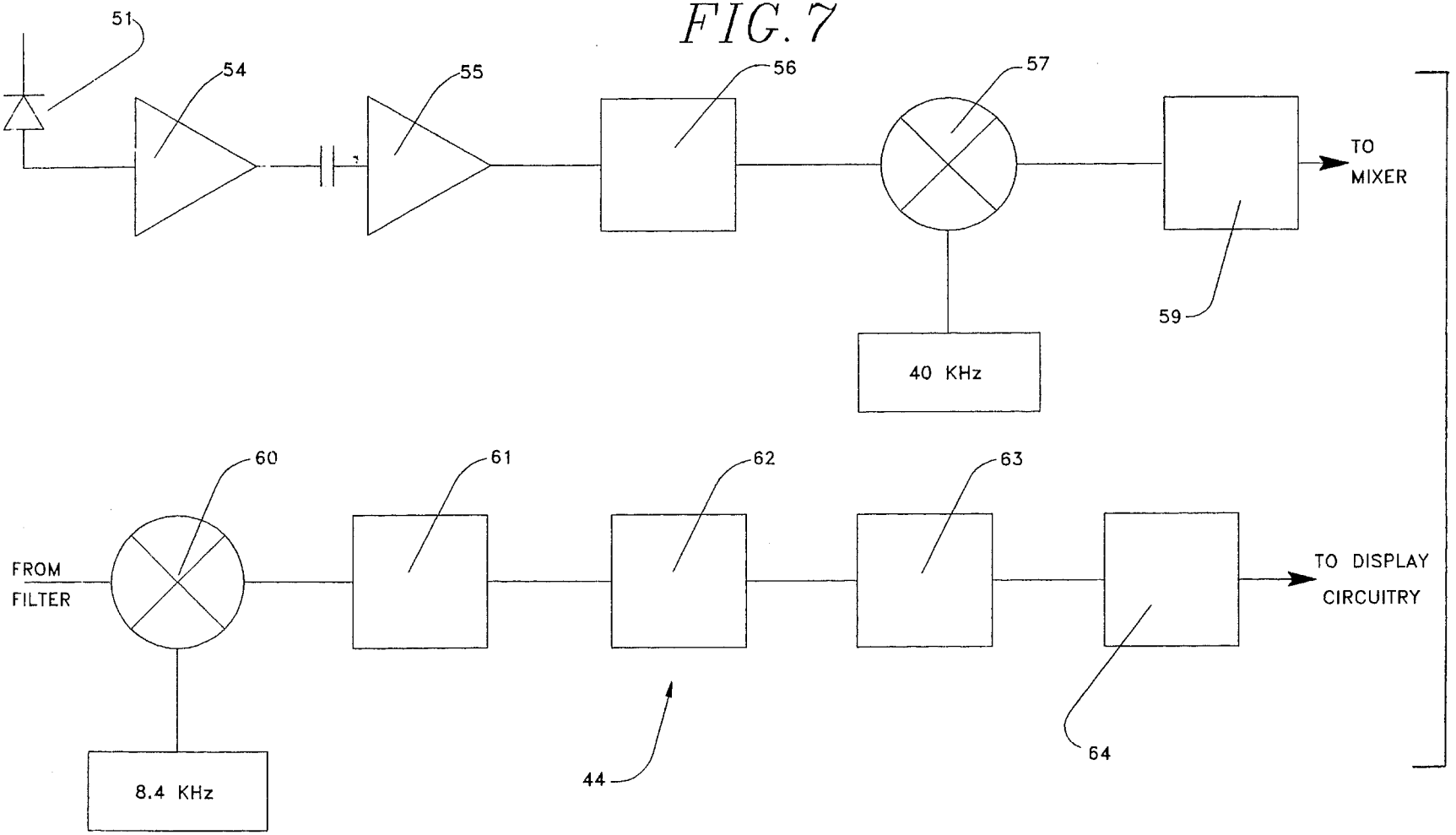
FIG. 7 is a block diagram of receiver circuitry included in the receiver of FIG. 1.

The photodiode 51 acts to convert the received light signal into an electrical signal that is then provided to the receiving circuitry 44. A block diagram of the receiving circuitry is shown in FIG. 7 and includes a preamp/amplifier stage, a filter/mixer stage and a detector/output stage. The preamp/amplifier stage is formed by a current amplifier 54 that is capacitively coupled to a second stage amplifier 55, formed of two noninverting amplifiers. The received signal from the amplifier 55 is then fed to a 32 kHz bandpass filter 56 having a Q preferably equal to 3 for the rejection of image frequencies of subsequent stages.

The filtered signal is next mixed with a 40 kHz frequency by a mixer 57 and passed through a 7.3 kHz bandpass filter 59. The output from the filter 59 is fed to a 8.4 kHz mixer 60 to yield an output signal of 1.1 kHz. This signal undergoes 2 kHz low pass filtering provided by a filter 61 and then 1.1 kHz bandpass filtering by a filter 62. The output from the filter 62 is supplied to a tone decoder 63 in the form of a phase-locked loop device that detects unique tones or frequencies and is set to detect a 1.1 kHz frequency and has a band of about 100 kHz. Upon detection of a correct tone or signal, an output is provided by the decoder 63 to a pulse shaper in the form of a one shot multivibrator 64.

The output signal from the one shot multivibrator 64 serves as a "hit" signal to indicate that the receiver 12 has received a light signal that it recognizes as a reflected signal from the pigeon 15. However, to verify the accuracy of "hit" signals provided by the receiving circuitry 44, the detecting circuitry 45 is utilized in conjunction therewith.

Figure 8:
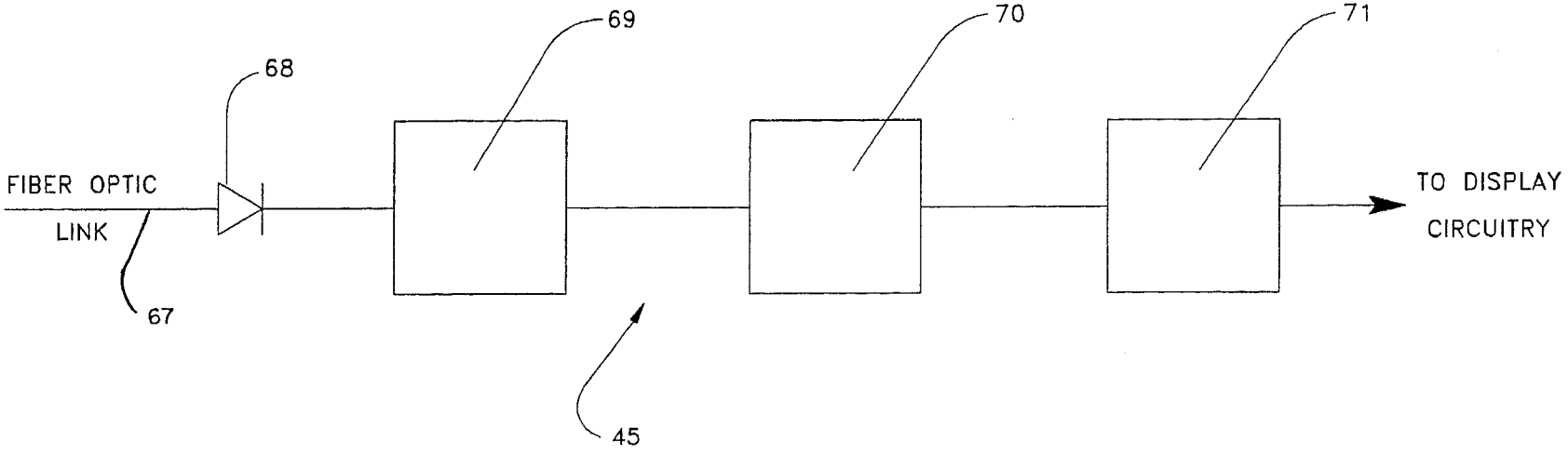
FIG. 8 is a block diagram of detecting circuitry included in the receiver of FIG. 1.
Figure 9:
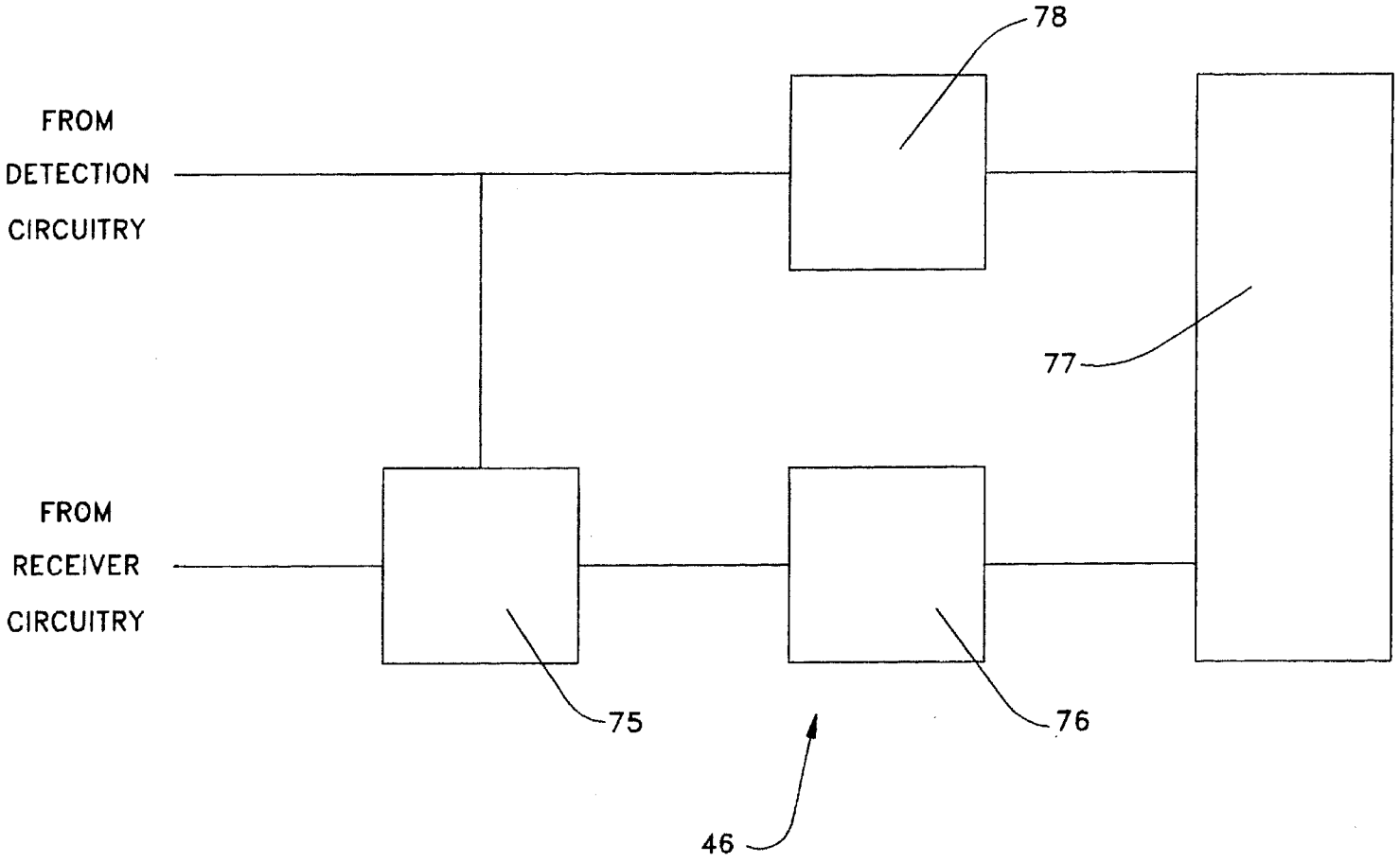
FIG. 9 is a block diagram of display circuitry included in the receiver of FIG. 1.

Turning now to FIG. 8, a block diagram of the detecting circuitry 45 is shown therein. The detecting circuitry 45 is designed to sense the emission of a laser beam by the transmitter 11 and provide in response thereto a "try" signal. The input of the detecting circuitry 45 is provided by a fiber optic link 67 that is best shown in FIG. 5 and has its free end clipped into the front of the barrel of the shotgun 10.

When the transmitter 11 is activated, a small portion of the transmitter beam is directed by the link 67 to a photodiode 68 that transforms the light beam into an electrical signal. The output of the diode 68 is fed to a two stage amplifier 69 and then through a 32.768 kHz bandpass filter 70 to a phase-locked loop tone decoder 71 that provides a signal that serves as a "try" signal. Thus, upon firing of the transmitter 11 and the sensing of same by the circuitry 45, the tone decoder 71 produces a "try" signal and such signal is then fed to the display circuitry 46 shown in FIG. 9.

The display circuitry 46 receives "hit" signals supplied by the receiving circuitry 44 and "try" signals from the detecting circuitry 45. The "try" and "hit" signals are both provided to a "hit" gate 75 that is adapted to provide a "hit" output signal upon the simultaneous receipt of "hit" and "try" signals. The "hit" output from the gate 75 is fed to a "hit" counter 76 and then to a visual display 77. Such output may also be provided to a sonalert to generate an audible sound when a "hit" is registered by the display 77.

The "try" signal from the detecting circuitry 45, in addition to being fed to the counter 75, also is directly supplied to a counter 78 and the display 77 to record the number of times that the transmitter 11 has been fired. Thus, the display 77 maintains a running record of the number of shots fired by the transmitter 11 and the number of actual "hits" perceived by the receiving circuitry 44. In this way, the detecting circuitry 45 together with the display circuitry 46 provide a verification of "hits" that are recorded by eliminating spurious "hit" signals that may be provided by the receiving circuitry 44 at a time when the transmitter 11 has not been fired. Consequently, the accuracy of the present invention in recording "hits" and "trys" is particularly high.

Although the present invention has been described with reference to the preferred embodiment, it should be understood by those skilled in the art that changes can be made in the structure and circuitry of such embodiment without departing from the true spirit and scope of the invention.

I claim:

1. A laser weapon simulator apparatus for use with a firearm comprising a firing chamber, a firing pin adjacent said firing chamber, and a barrel having a first end proximal said firing chamber and a second end distal said firing chamber, the apparatus being for practice in the shooting of the firearm at a target having reflective material thereon, said apparatus comprising:

(a) a laser beam transmitter contained in a housing that is adapted for being positioned in the firing chamber of the firearm and is actuable to emit a laser beam of short duration;

(b) a laser beam receiver adapted for mounting on the exterior of the firearm for receiving a portion of said laser beam that is reflected from the target and processing said portion to produce a "hit" signal;

(c) means for detecting the emission of said laser beam and producing a "try" signal in response thereto; and (d) display means that produces an output "hit" display signal upon the concurrent receipt of a "hit" signal from said receiver and a "try" signal from said detecting means.

2. A weapon simulator apparatus as described in claim 1 wherein said transmitter is actuated when struck by the firing pin of the firearm.

3. A weapon simulator apparatus as described in claim 2 wherein said receiver is mounted on the barrel of said firearm.

4. A weapon simulator apparatus as described in claim 3 wherein said detecting means includes a fiber optic link that is clipped to the end of the barrel of the firearm in such fashion that it senses the emission of a laser beam by said transmitter.

5. A weapon simulator apparatus as described in claim 4 wherein said receiver includes a light collecting member that is tubular in shape and serves as a hood for said receiver.

6. A weapon simulator apparatus as described in claim 5 wherein said display means produces an output "try" display signal upon the receipt of a "try" signal from said detecting means.

* * * * *